US006246177B1

(12) United States Patent
Xie et al.

(10) Patent No.: US 6,246,177 B1
(45) Date of Patent: Jun. 12, 2001

(54) PARTIAL DISCHARGE METHOD FOR OPERATING A FIELD EMISSION DISPLAY

(75) Inventors: Chenggang Xie, Phoenix; James E. Jaskie; Robert C. Rumbaugh, both of Scottsdale, all of AZ (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/560,363

(22) Filed: Apr. 28, 2000

(51) Int. Cl.[7] ..... G09G 3/10
(52) U.S. Cl. ..... 315/169.1; 313/309
(58) Field of Search ..... 315/169.3, 169.1; 313/309, 336, 351, 495

(56) References Cited

U.S. PATENT DOCUMENTS

| | | | |
|---|---|---|---|
| 4,281,272 | 7/1981 | Spilsbury | 315/1 |
| 5,229,682 | 7/1993 | Komatsu | 313/209 |
| 5,396,151 | 3/1995 | Cappels, Sr. | 315/8 |
| 5,541,473 | 7/1996 | Duboc, Jr. et al. | 313/422 |
| 5,801,486 | 9/1998 | Johnson et al. | 313/495 |
| 5,804,909 | 9/1998 | Nilsson et al. | 313/309 |
| 6,031,336 | 2/2000 | Rumbaugh et al. | 315/169.3 |
| 6,075,323 * | 6/2000 | Smith et al. | 315/169.1 |
| 6,104,139 * | 8/2000 | Elloway et al. | 315/169.3 |

* cited by examiner

*Primary Examiner*—Haissa Philogene
(74) *Attorney, Agent, or Firm*—Kevin D. Wills; James E. Klekotka

(57) ABSTRACT

A partial discharge method for operating a field emission display (100) having an anode (125), a spacer (106), and a plurality of electron emitters (116) includes the steps of causing electron emitters (116) to emit electrons (130), applying a scanning mode anode voltage to the anode (125), where the scanning mode anode voltage is selected to cause electrons (130) to be attracted toward anode (125), and, thereafter, applying a partial discharge voltage to anode (125). The partial discharge voltage is equal to about a maximum discharge voltage, where the maximum discharge voltage is defined as the maximum voltage that can be applied to anode (125) during the discharge mode of operation while maintaining invisibility of spacer (106).

4 Claims, 2 Drawing Sheets

PARTIAL DISCHARGE METHOD FOR OPERATING A FIELD EMISSION DISPLAY

REFERENCE TO RELATED APPLICATIONS

Related subject matter is disclosed in the following U.S. patent applications: (1) "Method for Reducing Charge Accumulation in a Field Emission Display," having the application Ser. No. 09/009,233, filed on Jan. 20, 1998, now U.S. Pat. No. 6,075,323and assigned to the same assignee; (2) "Field Emission Display Having an Invisible Spacer and Method Thereof," attorney docket number FD20016 filed on the same date herewith; and (3) "Method for Improving Life of a Field Emission Display," having the application Ser. No. 09/364,993, filed on Aug. 2, 1999, and assigned to the same assignee.

FIELD OF THE INVENTION

The present invention pertains to the area of methods for operating field emission displays and, more particularly, to methods for providing "invisible" spacers within a field emission display.

BACKGROUND OF THE INVENTION

It is known in the art to use dielectric spacer structures to maintain the separation distance between a cathode plate and an anode plate of a field emission display. It is also known that the dielectric spacer structures can become positively charged during the operation of the device. By diverting electrons away from cathodoluminescent phosphors that are proximate to the charged spacer structures, the charged spacer structures can cause gaps in the display image at the locations of the charged spacer structures. In this manner, the spacer structures become "visible" or discernible to the viewer.

Thus, it is known to be desirable to neutralize the electrical charge that accumulates on the spacer structures. It is known to achieve spacer invisibility by reducing the voltage at the anode plate to ground potential during an electron emission, and thereby direct the electrons toward charged surfaces within the display, including the charged surfaces of the spacer structures. Although this scheme achieves "invisibility" of the spacers, it can further result in undesirable effects, such as those due to electron bombardment of the cathode plate.

Accordingly, there exists a need for an improved method for operating a field emission display, which achieves "invisibility" of the spacer structures while reducing electron bombardment of the cathode plate.

Figure 1:
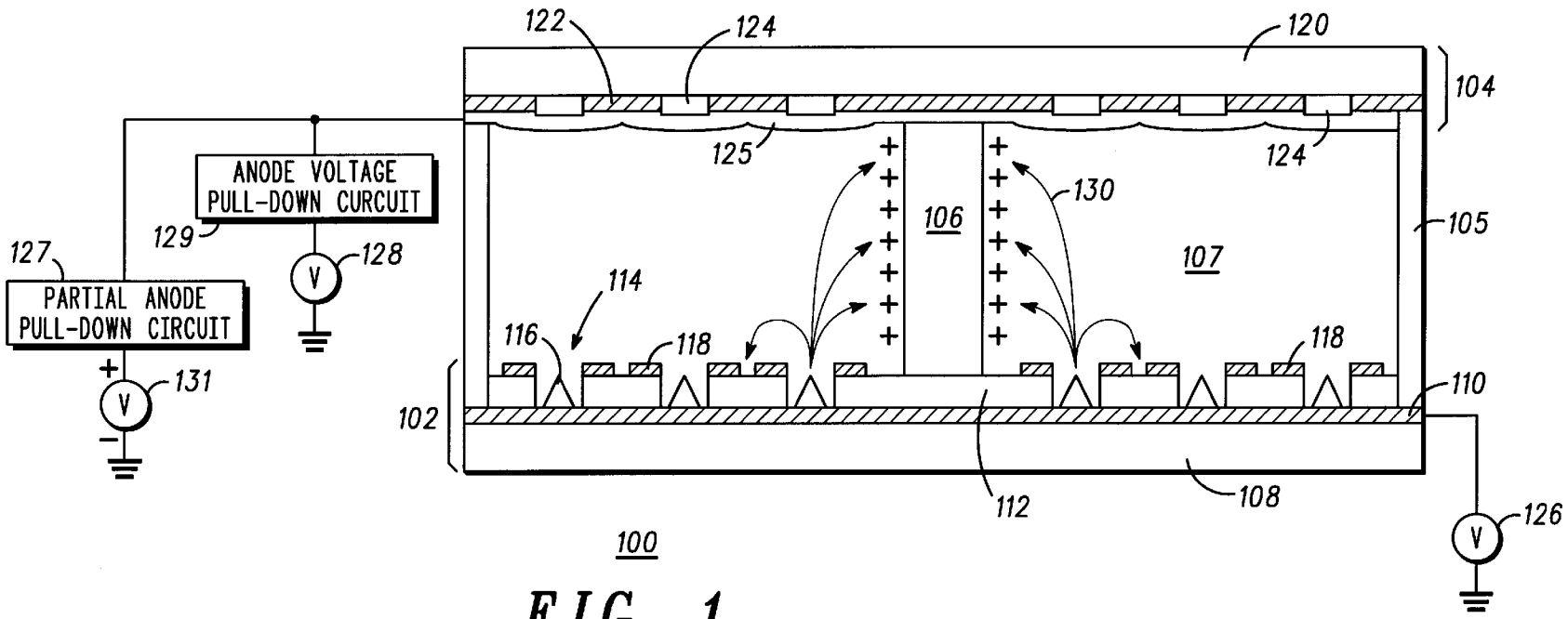
FIG. 1 is a cross-sectional view of a field emission display, which can be operated in accordance with the method of the invention.

It will be appreciated that for simplicity and clarity of illustration, elements shown in the drawings have not necessarily been drawn to scale. For example, the dimensions of some of the elements are exaggerated relative to each other. Further, where considered appropriate, reference numerals have been repeated among the drawings to indicate corresponding elements.

DESCRIPTION OF THE PREFERRED EMBODIMENT

The invention is for a method for operating a field emission display, which provides invisibility of spacer structures and which further reduces electron bombardment of the cathode plate. The partial discharge method of the invention includes the step of applying a partial discharge voltage to the anode during a discharge mode of operation. The partial discharge voltage is slightly less than or equal to a maximum discharge voltage. The maximum discharge voltage is defined as the maximum voltage that can be applied to the anode during a discharge mode of operation while maintaining invisibility of the spacers. Use of the partial discharge voltage reduces the fraction of the electron emission current that is received by non-spacer surfaces. In this manner, the method of the invention can be used to achieve spacer invisibility while minimizing undesired electron bombardment of the cathode plate.

FIG. 1 is a cross-sectional view of a field emission display (FED) 100, which can be operated in accordance with the partial discharge method of the invention. As illustrated in FIG. 1, FED 100 includes a cathode plate 102 and an anode plate 104. Cathode plate 102 includes a substrate 108, which can be made from glass, silicon, and the like. A cathode 110 is disposed upon substrate 108. Cathode 110 is connected to a first voltage source 126. A dielectric layer 112 is disposed upon cathode 110 and further defines a plurality of emitter wells 114.

An electron emitter 116 is disposed within each of emitter wells 114. In the embodiment of FIG. 1, electron emitter 116 is a Spindt tip emitter. However, the partial discharge method of the invention can be performed using FED's having electron emitters other than Spindt tip emitters, such as surface emitters, edge emitters, and the like.

Cathode plate 102 further includes a plurality of gate extraction electrodes 118, which are disposed on dielectric layer 112 and are connected to a second voltage source (not shown). Application of selected potentials to cathode 110 and gate extraction electrodes 118 can cause electron emitters 116 to emit an electron current, which is represented by arrows 130 in FIG. 1.

Anode plate 104 is spaced apart from cathode plate 102 to define an interspace region 107 therebetween. The separation distance is maintained by a spacer 106 and a frame 105. Anode plate 104 includes a transparent substrate 120 made from a solid, transparent material, such as a glass. A black surround 122 is disposed on transparent substrate 120 and is preferably made from chrome oxide. A plurality of phosphors 124 are disposed on transparent substrate 120, within openings defined by black surround 122. Phosphors 124 are cathodoluminescent and emit light upon activation by electrons emitted by electron emitters 116 during a scanning mode of operation of FED 100.

An anode 125, which is preferably made from aluminum, defines a blanket layer overlying phosphors 124 and black surround 122. Anode 125 is connected to a third voltage source 128. Methods for fabricating cathode plates and anode plates for matrix-addressable FED's are known to one of ordinary skill in the art.

The potential applied to anode 125 can be manipulated by an anode voltage pull-down circuit 129 and a partial anode pull-down circuit 127. The outputs of anode voltage pull-down circuit 129 and partial anode pull-down circuit 127 are connected to anode 125. A fourth voltage source 131 is connected to partial anode pull-down circuit 127.

Circuits suitable for use for anode voltage pull-down circuit 129 are described in U.S. pat. No. 6,031,336 issued Feb. 29, 2000, and in U.S. patent application Ser. No. 09/009,233filed on Jan. 20, 1998, now U.S. Pat. No. 6,075,323, and assigned to the same assignee, the relevant portions of which are hereby incorporated by reference.

Partial anode pull-down circuit 127 operates to drop the anode voltage from a scanning mode anode voltage, $V_S$, to a partial discharge voltage, $V_D$, where the value of the partial discharge voltage is above ground potential. The partial discharge voltage can be, for example, in the range of 100 to 400 volts above ground potential. Partial anode pull-down circuit 127 can include a diode, which is connected in series to the output of partial anode pull-down circuit 127. The output of partial anode pull-down circuit 127 is connected to the input of anode 125. The value of fourth voltage source 131 is chosen to correspond with the desired value of partial discharge voltage, $V_D$. Other methods of setting $V_D$ are possible.

Figure 2:
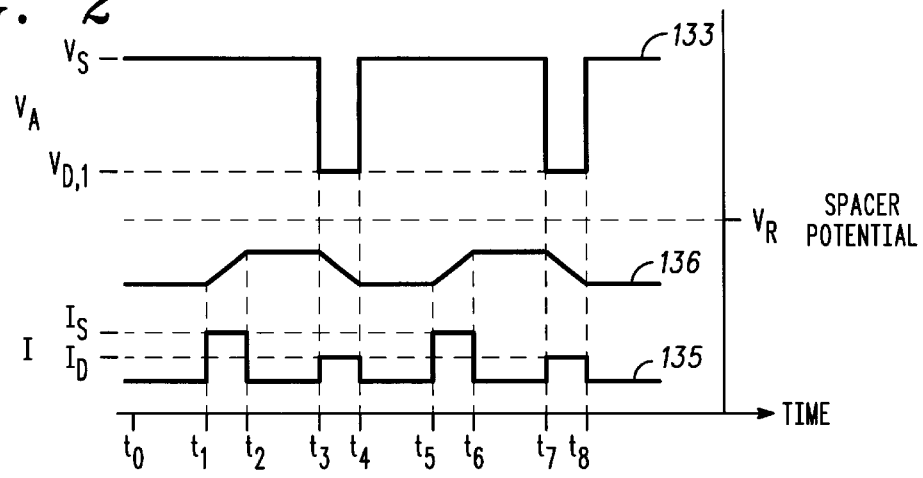
FIGS. 2–4 are timing diagrams illustrating the determination of the partial discharge voltage for use in a method for operating a field emission display, in accordance with the partial discharge method of the invention.
Figure 3:
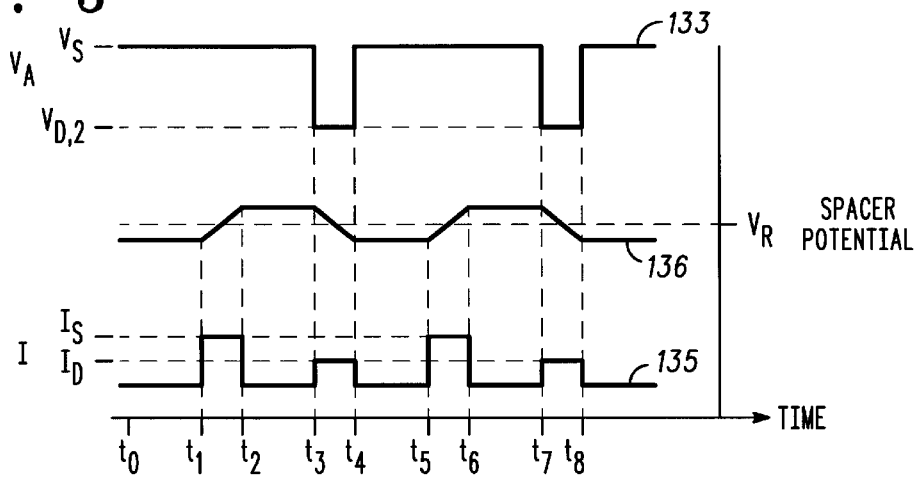
Figure 4:
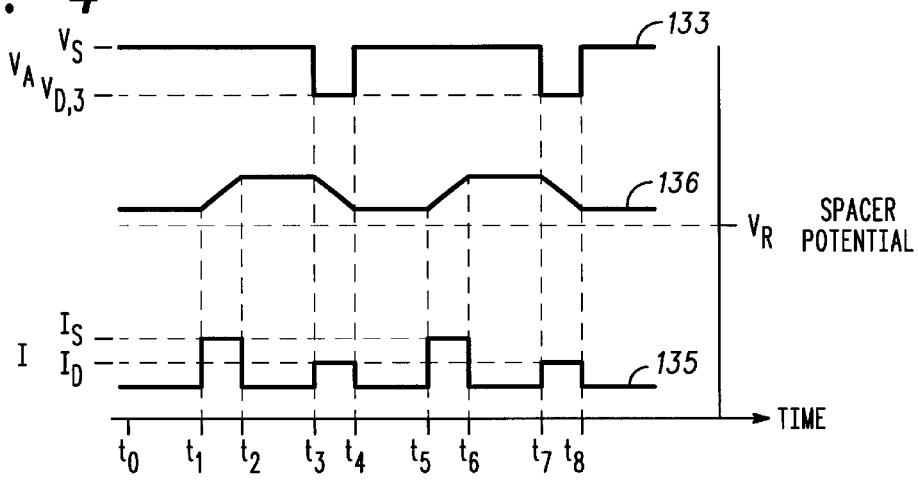

FIGS. 2–4 are timing diagrams illustrating a method for determining the partial discharge voltage, $V_D$, for use in the partial discharge method of the invention. In general, the operation of FED 100 can be divided into two modes of operation: the scanning mode and the discharge mode. During the scanning mode, rows of electron emitters 116 are sequentially caused to emit electrons, which are received by phosphors 124. During the discharge mode, some or all of electron emitters 116 are caused to emit electrons, a substantial fraction of which are received by the charged surfaces of spacer 106, as illustrated in FIG. 1. In one example of the method of the invention, only electron emitters 116 proximate to spacer 106 are caused to emit during the discharge mode. The method of the invention is useful for minimizing the fraction of the electrons that are received by non-spacer surfaces during this discharge mode of operation.

The scanning mode of operation and discharge mode of operation of FED 100 will be described with reference to FIG. 2. A graph 133 represents the voltage, $V_A$, which is applied to anode 125. A graph 135 represents the electron current, I, which is emitted by electron emitters 116 that are proximate to spacer 106. A graph 136 represents the potential at spacer 106.

The scanning mode of operation occurs from time $t_0$ to $t_3$ and from time $t_4$ to $t_7$. The discharge mode of operation occurs from time $t_3$ to $t_4$ and from time $t_7$ to $t_8$. In the example of FIGS. 2–4, the discharge mode occurs at the end of each frame. However, other timing schemes can be employed, such as performing the discharge after a multiple of frames. In the example of FIG. 2, the cycle that occurs between times $t_3$ and $t_7$ is repeated during the operation of FED 100.

During the scanning mode of operation of FED 100, the potential at anode 125 is equal to a scanning mode anode voltage, $V_S$. When electron emitters 116 proximate to spacer 106 are addressed during the scanning mode, they generate an electron current equal to a scanning, mode electron current, $I_S$. Also during the scanning mode, the potential at spacer 106 increases, as indicated by graph 136. The actual representation of the potential at spacer 106 may not be linear; graph 136 is provided to illustrate the general upward trend of this potential during the scanning mode of operation. The scanning mode duration is equal to the time elapsed between times $t_4$ and $t_7$.

In accordance with the partial discharge method of the invention, during the discharge mode of operation of FED 100, the potential at anode 125 is equal to a partial discharge voltage (not particularly indicated in FIG. 2), $V_D$. FIGS. 2–4 are useful for describing a method for selecting $V_D$. During the discharge mode, the electron current from electron emitters 116 proximate to spacer 106 is equal to a discharge mode electron current, $I_D$. The discharge mode electron current reduces the potential at spacer 106, as indicated by graph 136. The actual representation of the potential at spacer 106 may not be linear; graph 136 is provided to further illustrate the general downward trend of this potential during the discharge mode of operation. The discharge mode duration is equal to the time elapsed between times $t_3$ and $t_4$.

The selection of the partial discharge voltage will now be described with reference to FIGS. 2–4. A reference spacer potential, $V_R$, is indicated in FIGS. 2–4 for illustrating the general upward shift in spacer potential as the partial discharge voltage is increased. First, the operating variables, other than the partial discharge voltage, are selected, thereby defining a selected operating condition, which is further to be employed during the normal operation of FED 100. Thus, at least the following variables are defined: the scanning mode electron current, the scanning mode duration, the scanning mode anode voltage, the discharge mode electron current, and the discharge mode duration. FED 100 is operated using these selected values. A first discharge voltage, $V_{D,1}$, is selected and applied to anode 125 during the discharge mode of operation, as illustrated in FIG. 2. The first discharge voltage is selected to result in the invisibility of spacer 106. Thus, the first discharge voltage will have a relatively low value. For example, the first discharge voltage can be equal to about ground potential.

After a steady state condition is achieved with the first discharge voltage and while maintaining the selected operating condition, the discharge voltage is increased at regular increments until a value is reached that causes spacer visibility. For example, the discharge voltage can be increased from $V_{D,1}$ to a second discharge voltage, $V_{D,2}$, as illustrated in FIG. 3. In the example of FIGS. 2–4, $V_{D,2}$ does not cause spacer visibility. Thus, after a steady state condition is achieved with $V_{D,2}$, the discharge voltage is further increased to a third discharge voltage, $V_{D,3}$. In this example, $V_{D,3}$ causes spacer visibility. After this first iteration, the process of FIGS. 2–4 can be repeated using a higher starting value for the discharge voltage, which is known from the first iteration to cause spacer invisibility, and using smaller increments to increase the discharge voltage until spacer visibility is achieved. One or more iterations can be performed. The partial discharge voltage for use in the method of the invention is preferably selected to be equal to the discharge voltage that caused spacer invisibility, which immediately preceded the first discharge voltage that caused spacer visibility during the last iteration. The particular value for the partial discharge voltage depends upon the selected operating condition, the display structure, and the materials of fabrication.

In general, the partial discharge voltage is selected to be just sufficient to cause invisibility of the spacers for the selected operating condition. Thus, the partial discharge method for operating a field emission display, in accordance with the invention, preferably includes the step of reducing during the discharge mode of operation a voltage at the anode only to an extent sufficient to cause invisibility of spacers. Preferably, the partial discharge voltage is equal to about a maximum discharge voltage, where the maximum discharge voltage is defined as the maximum voltage that can be applied to the anode during a discharge mode of operation while maintaining invisibility of the spacers.

Preferably, the partial discharge voltage is within a range defined by the maximum discharge voltage and a voltage equal to fifty percent of the maximum discharge voltage. Most preferably, the partial discharge voltage is within a range defined by the maximum discharge voltage and a voltage equal to ninety percent of the maximum discharge voltage. The method of the invention does not necessarily require that spacer surfaces be completely discharged during the discharge mode of operation.

As further illustrated in FIGS. 2–4, the discharge mode electron current, $I_D$, is preferably less than the scanning mode electron current, $I_S$, and the scanning mode duration is preferably greater than the discharge mode duration. Preferably, the discharge mode duration is greater than 1 microsecond. Most preferably, the discharge mode duration is within a range of 50–150 microseconds.

In summary, the invention is for a method for operating a field emission display. The partial discharge method of the invention includes the step of reducing during the discharge mode of operation a voltage at the anode only to an extent sufficient to cause invisibility of spacers within the display. While selection of discharge voltages, which are less than the partial discharge voltage of the invention, can provide invisibility of spacers, use of the lower voltages can result in greater electron bombardment of the cathode plate. Thus, by employing the partial discharge voltage, the method of the invention provides the benefit of less electron bombardment of the cathode plate as well as spacer invisibility.

While we have shown and described specific examples of the present invention, further modifications and improvements will occur to those skilled in the art. For example, the discharge current can be generated by causing the entire array of electron emitters to emit electrons. We desire it to be understood, therefore, that this invention is not limited to the particular forms shown, and we intend in the appended claims to cover all modifications that do not depart from the spirit and scope of this invention.

We claim:

1. A partial discharge method for operating a field emission display having an anode, a spacer, and a plurality of electron emitters, the partial discharge method comprising the steps of:

causing the plurality of electron emitters to emit electrons;

applying a scanning mode anode voltage to the anode, wherein the scanning mode anode voltage is selected to cause electrons emitted by the plurality of electron emitters to be attracted toward the anode; and thereafter, applying a partial discharge voltage to the anode, wherein the partial discharge voltage is within a range defined by a maximum discharge voltage and a voltage equal to fifty percent of the maximum discharge voltage, and wherein the maximum discharge voltage is defined as the maximum voltage that is applied during a discharge mode of operation to the anode while maintaining invisibility of the spacer.

2. The partial discharge method for operating a field emission display as claimed in claim 1, wherein the partial discharge voltage is within a range defined by a maximum discharge voltage and a voltage equal to ninety percent of the maximum discharge voltage.

3. The partial discharge method for operating a field emission display as claimed in claim 1, wherein the step of causing the plurality of electron emitters to emit electrons comprises the steps of causing the plurality of electron emitters to emit electrons to define a scanning mode electron current during the step of applying a scanning mode anode voltage to the anode and causing the plurality of electron emitters to emit electrons to define a discharge mode electron current during the step of applying a partial discharge voltage to the anode.

4. The partial discharge method for operating a field emission display as claimed in claim 3, wherein the discharge mode electron current is less than the scanning mode electron current.

* * * * *